US009021628B2

(12) United States Patent
Schäfer et al.

(10) Patent No.: US 9,021,628 B2
(45) Date of Patent: May 5, 2015

(54) DRAIN, IN PARTICULAR FOR FLOOR LEVEL SHOWERS

(75) Inventors: Patrick Schäfer, Hagen (DE); Johannes Arndt, Lennestadt (DE); Reinhard Schulte, Eslohe (DE); Ulrich Groβkopf, Finnentrop (DE); Klaus Skrodolies, Lennestadt (DE)

(73) Assignee: Viega GmbH & Co. KG, Attendorn (DE)

( * ) Notice: Subject to any disclaimer, the term of this patent is extended or adjusted under 35 U.S.C. 154(b) by 324 days.

(21) Appl. No.: 12/882,290

(22) Filed: Sep. 15, 2010

(65) Prior Publication Data

US 2011/0067174 A1 Mar. 24, 2011

(30) Foreign Application Priority Data

Sep. 24, 2009 (DE) ..... 20 2009 012 826

(51) Int. Cl.
*E03C 1/12* (2006.01)
*E03F 5/04* (2006.01)

(52) U.S. Cl.
CPC ..... *E03F 5/0408* (2013.01); *E03F 5/04* (2013.01); *E03F 2005/0413* (2013.01); *E03F 2005/0418* (2013.01)

(58) Field of Classification Search
CPC ..... E04F 5/04; E04F 5/042; E04F 5/0407; E04F 5/0708; E04F 5/0409; E04F 2005/0412; E04F 2005/0413; E04F 2005/0416
USPC ..... 4/679–681, 688, 62, 507, 650–652; 220/DIG. 6
See application file for complete search history.

(56) References Cited

U.S. PATENT DOCUMENTS

| | | | | | |
|---|---|---|---|---|---|
| 97,160 | A | * | 11/1869 | Burleigh | 210/247 |
| 493,750 | A | * | 3/1893 | Budde | 137/247.29 |
| 497,465 | A | * | 5/1893 | Burgoin | 4/681 |
| 1,751,877 | A | * | 3/1930 | Nance | 4/679 |
| 3,651,826 | A | * | 3/1972 | Kojima | 4/679 |
| 4,026,317 | A | * | 5/1977 | Ekstrom | 137/216.1 |
| 4,198,717 | A | * | 4/1980 | Kessel | 4/286 |
| 4,254,512 | A | * | 3/1981 | Soderstrom | 4/679 |
| 4,263,138 | A | * | 4/1981 | Kessel | 210/163 |
| 6,299,764 | B1 | * | 10/2001 | White et al. | 210/164 |
| 7,131,150 | B1 | * | 11/2006 | Havens | 4/288 |

(Continued)

FOREIGN PATENT DOCUMENTS

| | | | |
|---|---|---|---|
| DE | 8904624 | U1 | 6/1989 |
| DE | 202005012802 | | 8/2005 |

(Continued)

*Primary Examiner* — Paul R Durand
*Assistant Examiner* — Erin Deery
(74) *Attorney, Agent, or Firm* — The Webb Law Firm

(57) ABSTRACT

The invention relates to a drain (1'), in particular for floor level showers, the drain comprising a pot shaped drain housing (1.1) including a shell or pot shaped base component (1.2) without a pipe connection, a laterally disposed pipe connection (1.5) and an inlet opening (1.3) at a top side of the base component, and an immersion pipe (2) which is insertable into the drain housing through the inlet opening (1.3) and defines a stench trap with the drain housing. In order to be able to adapt such a drain to various installation conditions in a flexible manner, so that the installation height, water lock height and drain output of the drain is variable, the invention provides a solution wherein the base component (1.2) is connected in an elevation-adjustable and liquid-tight manner with the drain housing (1.1).

16 Claims, 4 Drawing Sheets

(56) References Cited

U.S. PATENT DOCUMENTS

| | | | | |
|---|---|---|---|---|
| 2005/0229305 | A1* | 10/2005 | Nocera et al. | 4/679 |
| 2007/0204399 | A1* | 9/2007 | DeGooyer | 4/679 |
| 2009/0172877 | A1* | 7/2009 | Ball | 4/652 |
| 2010/0235982 | A1* | 9/2010 | Stimpson et al. | 4/679 |

FOREIGN PATENT DOCUMENTS

| | | | |
|---|---|---|---|
| DE | 202005017965 | | 11/2005 |
| EP | 0084398 | A2 | 7/1983 |
| GB | 2094847 | A | 9/1982 |
| WO | 2007110595 | A3 | 10/2007 |

* cited by examiner

DRAIN, IN PARTICULAR FOR FLOOR LEVEL SHOWERS

The invention relates to a drain, in particular for floor level showers, with a pot shaped drain housing including a shell- or pot shaped base component without a pipe connection, a laterally disposed pipe connection and an inlet opening at its top side and an immersion pipe which is insertable into the drain housing through the inlet opening and forms a stench trap with the drain housing.

A drain of this type is known e.g. from DE 20 2005 012 802 U1 or DE 20 2005 017 965 U1.

The installation space which exists or can be provided for constructing a floor level shower on a bath room floor for receiving a floor drain housing including a stench trap is typically limited. In particular because the concrete floor or concrete ceiling below the shower should not be substantially broken through or weakened for structural reasons and also for reasons of fire protection. Furthermore a low floor screed is desirable in particular for refurbishing old buildings. Therefore numerous floor drains with stench trap with relatively flat configurations have already been developed.

In many cases, however, a sufficiently deep installation space for receiving a floor drain with integrated stench trap is available, so that there is an option then to size the water lock height in the stench trap relatively large.

It is the object of the present invention to provide a drain with stench trap in particular for floor level showers, wherein the drain is adaptable to various installation conditions in a flexible manner, so that its installation height, water lock height and drain output is variable.

This object is accomplished through a drain with the features of claim 1.

The drain according to the invention is characterized in that its base component is connected to the drain housing in an elevation-adjustable and liquid-tight manner.

Thus, the submersible pipe is preferably configured so that it has to be shortened through cutting off a pipe section in order to reduce the axial length of the immersion pipe. The immersion pipe which is removable from the drain housing and preferably configured in one piece can thus be shortened to the required length as necessary, e.g. with a saw.

The advantage of the drain according to the invention is in particular that the drain does not have fixed parameters with respect to installation height, water lock height and drain output like a conventional drain, but it is variably adjustable with these respects on site in a simple manner. The adjustment can be performed according to the primary requirements. For example when the smallest possible installation height (total height) is required this can be implemented through respective elevation adjustment of the base component relative to the drain housing. The axial length of the immersion pipe can then be adjusted to the set total height through shortening the immersion pipe, wherein thus a maximum water lock height or a maximum drain output can be adjusted for a small total height of the drain or a compromise between maximum water lock height and maximum drain output can be adjusted. The adjustment of the drain according to the invention is performed as a function of the parameter which is relevant in the particular situation.

In order to facilitate a simple continuous elevation adjustment of the base component relative to the drain housing a preferred embodiment of the drain according to the invention provides that the base component and the drain housing are respectively provided with a thread so that they can be threaded into one another.

The thread between the base component and drain housing is thus preferably provided, so that it provides a seal function for liquids without using an additional seal. However, an annular seal can also be advantageously provided between the base component and the drain housing and/or the base component can include a collar defining an annular seal surface according to an alternative configuration.

As alternative to providing a thread between the drain housing and its base component another advantageous embodiment of the invention provides that locking elements are provided at the base component and the drain housing, so that the base component is elevation adjustable in increments relative to the rest of the drain housing. For this alternative embodiment of the drain according to the invention an annular seal is preferably disposed between the base component and the drain housing.

In order to be able to adapt also the length of the immersion pipe in a simple manner another preferred embodiment of the drain according to the invention provides that the immersion pipe includes plural axially offset annular grooves and/or annular protrusions at an outside of the immersion pipe. The annular grooves or the annular protrusions are used as a support for a cutting tool, e.g. a saw, and facilitate the fabrication of a cutting plane extending orthogonal to the vertical axis of the immersion pipe, so that the annular bottom edge of the shortened immersion pipe is substantially disposed horizontal in an installed position of the immersion pipe.

In another preferred embodiment of the drain according to the invention it is provided that the immersion pipe defines an annular drain channel with the base component and/or the drain housing, wherein the width of the cross section of the drain channel increases from the bottom to the top. This configuration facilitates reliable liquid drainage and furthermore counteracts undesirable suction extraction of the locking water in the stench trap when there is a vacuum in the sewer conduit connected to the drain.

Another advantageous embodiment of the drain according to the invention provides that the drain housing includes an overflow edge on the inside of the drain housing, wherein the overflow edge protrudes in vertical direction and extends transversal to the longitudinal center axis of the pipe connection and includes an elevation offset viewed in transversal or orthogonal direction relative to the longitudinal center axis of the pipe connection. The overflow edge forms a water lock barrier which limits an outflow of the water lock due to a suction effect in the connected sewer conduit and thus assures the function of the stench trap in spite of the suction effect.

The elevation offset influences the flow direction of water flowing out from the drain, in particular the flow direction of a water-air mix which may be formed at the same time. The water-air mix is thus run into the lowest spot of the water lock barrier (overflow edge), so that an air gap or air channel is formed which relieves the vacuum in the sewer conduit and thus prevents a loss of the locking effect of the stench trap.

With respect to influencing the flow direction of the water or the water-air mix flowing from the drain, it is furthermore advantageous according to another configuration of the drain according to the invention when at least one divider wall or bulk head is integrally formed at the overflow edge (water lock barrier) which extends in a direction towards the immersion pipe. Preferably the divider wall (bulk head) is integrally formed with the overflow edge in the portion of the elevation offset and extends substantially in vertical direction. When water flows out based on a suction effect caused by a vacuum in the sewer conduit, the divider wall causes a separation of outflowing water from the water-air mix or from the air channel formed in the water flow, so that more water is retained in the drain housing through the divider wall.

Another advantageous embodiment of the drain according to the invention includes forming a drain channel expansion viewed in drain direction in front of the overflow edge (water lock barrier), wherein the drain channel expansion tapers towards the overflow edge. The drain channel expansion is preferably a portion of a horizontal disc shaped drain section which is defined by the immersion pipe and the drain housing, wherein the volume of the disc shaped drain channel section is greater than or equal to the volume within the immersion pipe which is defined by an upper horizontal plane extending tangential to the overflow edge and by a lower horizontal plane tangential to the lower end of the immersion pipe. This configuration assures that the relatively small water volume within the immersion pipe is partially or completely received in the volume of the horizontal drain channel disc section when the water volume in the immersion pipe is sucked out due to a vacuum in the connected sewer conduit, so that the water volume can flow back after the vacuum is relieved, so that a sufficient water lock always remains in the drain and thus assures the locking function of the stench trap. The drainage channel expansion or the volume of the horizontal drainage channel disc section provides a suction safety which facilitates configuring the drainage particularly flat, so that is has a relatively small overall height.

Additional preferred embodiments of the drain according to the invention are provided in the dependent claims.

Subsequently the invention is described in more detail with reference to a drawing figure illustrating plural embodiments, wherein.

Figure 1:
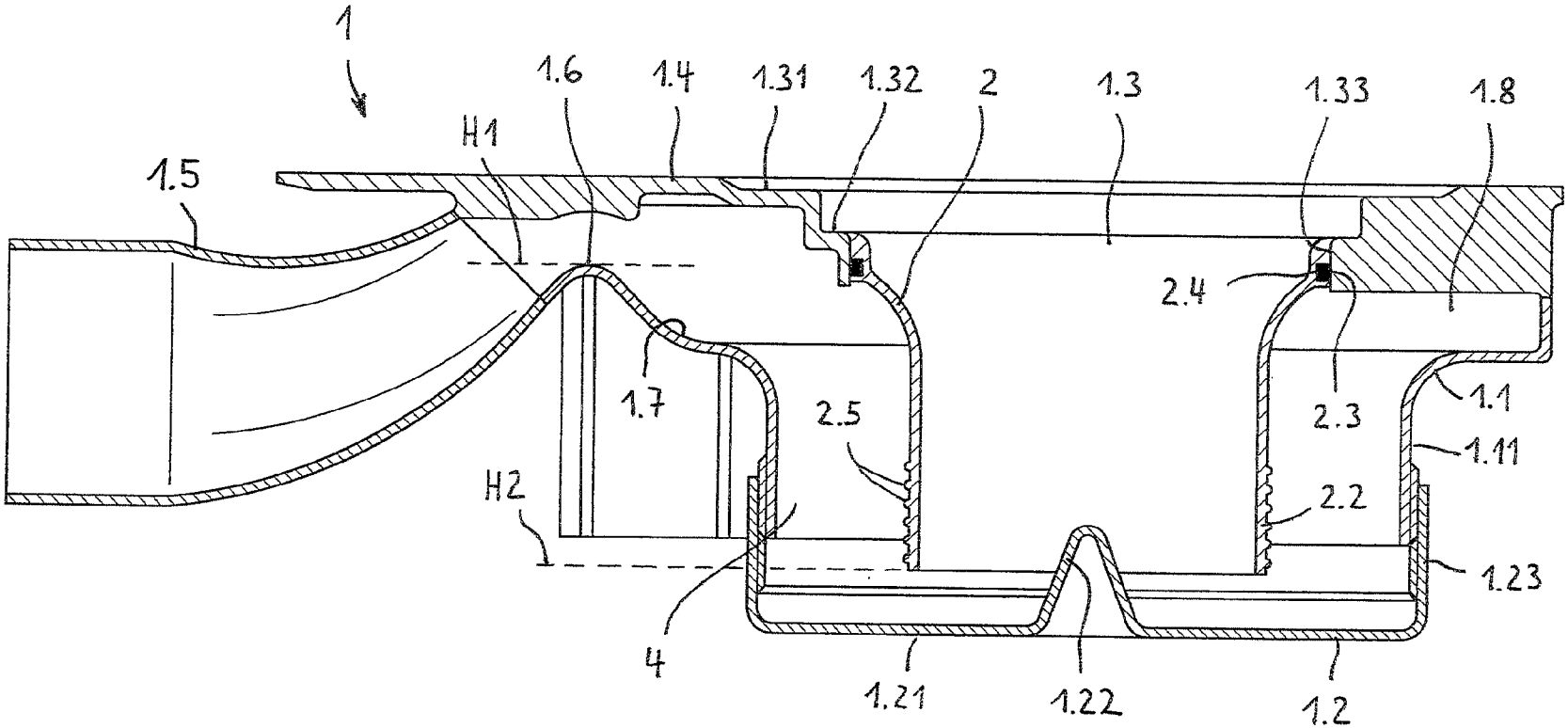
FIG. 1 illustrates a vertical sectional view of a drain according to the invention.

The drain 1, 1' illustrated in the drawing is configured for installation in a screed or concrete floor, e.g. for providing a drain for a floor level shower.

The drain 1, 1' includes a pot shaped housing 1.1 which includes a shell or pot shaped base component 1.2 and an inlet opening 1.3 at its top side. The inlet opening 1.3 is configured in a cover component 1.4 which is connected liquid tight with a housing 1.1, preferably welded together or glued together. The base component 1.2 does not include a pipe connection for connecting a sewage conduit (not illustrated). Rather a respective pipe connection is disposed laterally at the drainage housing 1.1. The pipe connection 1.5 is connected with the drain housing 1.1 and the cover component 1.4 through a welded or glued connection.

The drain 1, 1' furthermore includes an immersion pipe 2 which is insertable into the drain housing 1.1 through the inlet opening 1.3 and forms a stench trap with the drain housing 1.1. The immersion pipe 2 does not contact the base component 1.2 in an installed condition. The immersion pipe 2 rather protrudes in assembled condition freely with a radial offset into the shell shaped base component 1.2, wherein the lower end of the immersion pipe 2 terminates at a distance from the base of the base component 1.2. The inlet opening 1.3 is configured with steps viewed in a vertical sectional view. It includes an upper annular circumferential shoulder 1.31 in which a seal foil (not illustrated) can extend with a downward slope in a direction towards the immersion pipe 2.

The seal foil can e.g. be applied in the form of an initially liquid sealing compound, e.g. a so called liquid foil. Below the upper shoulder 1.31 a second, also annular circumferential shoulder 1.32 is configured in the cover component 1.4 of the drain. The second shoulder 1.32 is used for receiving a frame or adapter (not shown) in a positive locking manner, wherein a drain grid is in turn inserted into the frame or adapter.

Below the second shoulder 1.32 a cylindrical support surface 1.33 is configured which is used for supporting the immersion pipe 2. The immersion pipe 2 which is removable from the drain housing 1.1 includes an external annular groove 2.3 proximal to its upper end, wherein the groove is configured for receiving a seal ring. The seal ring 2.4 inserted into the annular groove 2.3 causes a frictional connection between the immersion pipe 2 and the drain housing 1.1 or its cover portion 1.4.

The base component 1.2 of the drain 1, 1' has an essentially planar base 1.21 with a cone shaped base section 1.22 protruding into the immersion pipe 2. The cone shaped base section 1.22 improves the deflection of the draining liquid in the portion of the base 1.21. This counteracts a backing-up of the draining liquid when the liquid feed is relatively high and thus improves the drain output.

The base component 1.2 of the drain is connected with the housing 1.1 such that the elevation is adjustable. For this purpose the base component 1.2 and the drain housing 1.1 respectively include circular cylindrical sections 1.11, 1.23, at which sections threads 1.12, 1.24 are configured which are threadable into one another. In the embodiment illustrated in FIGS. 1 and 2 the shell shaped base component 1.2 includes an inner thread 1.24 and the circular cylindrical 1.11 section of the drain housing 1.1 associated with the base component includes an exterior thread 1.12.

Figure 2:
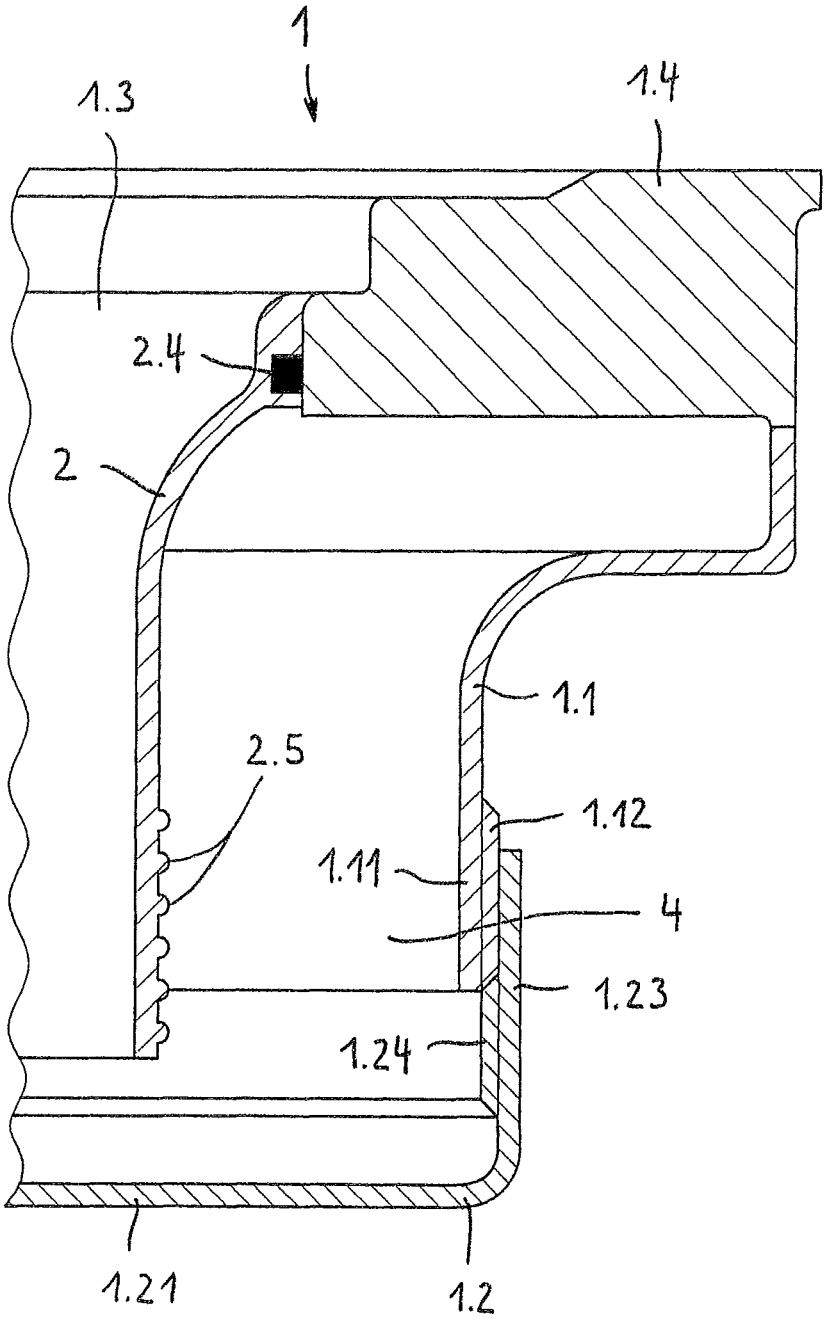
FIG. 2 illustrates an enlarged detail view of FIG. 1.

The threaded connection between the base component 1.2 and the drain housing 1.1 according to FIGS. 1 and 2 is preferably configured self sealing, so that a liquid tight connection is provided herein without an additional seal compound, wherein the liquid tight connection simultaneously facilities an elevation adjustment 1.2 relative to the drain housing 1.1.

Figure 3:
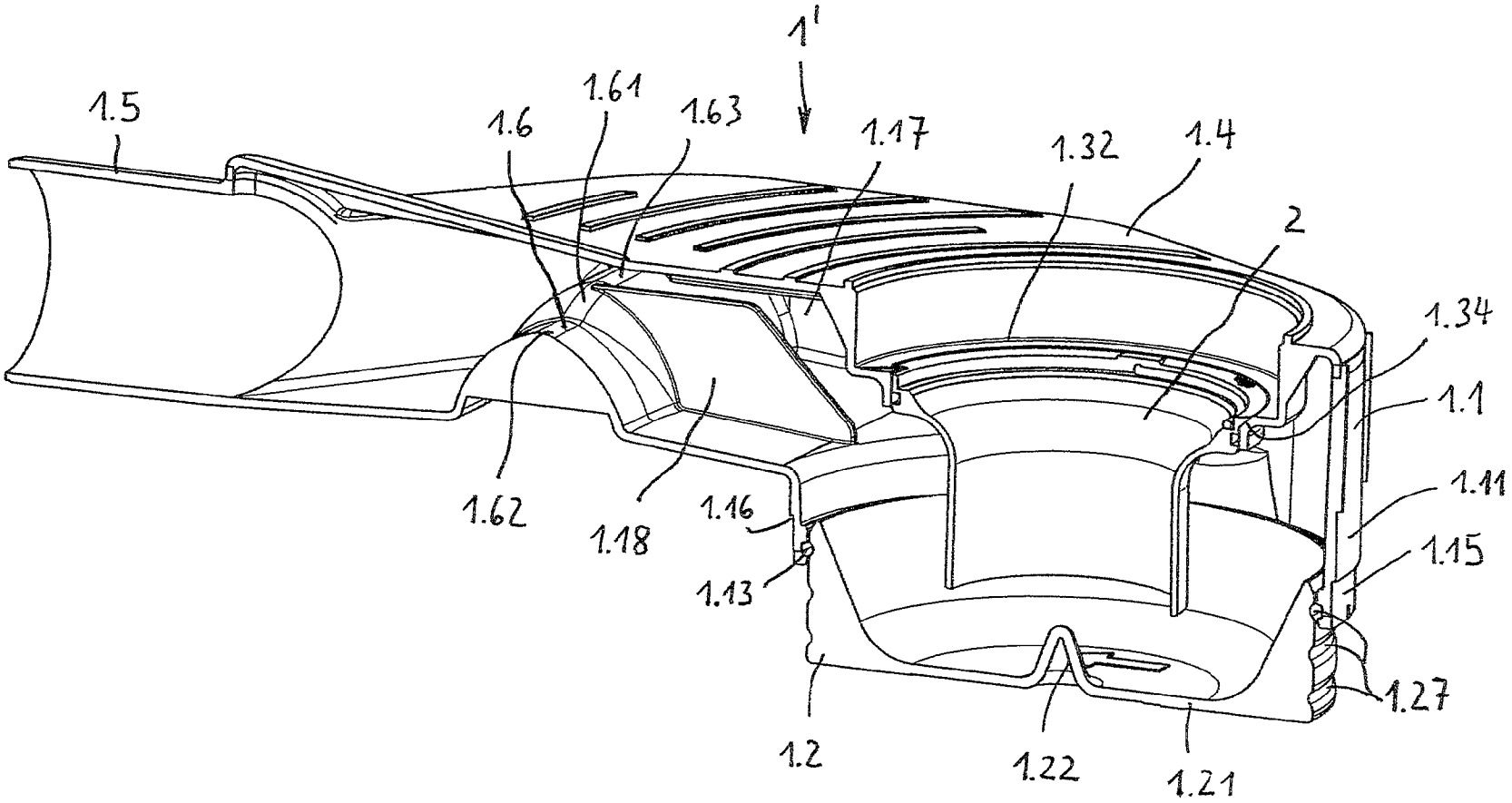
FIG. 3 illustrates a second embodiment of a drain according to the invention in a vertical sectional view.
Figure 4:
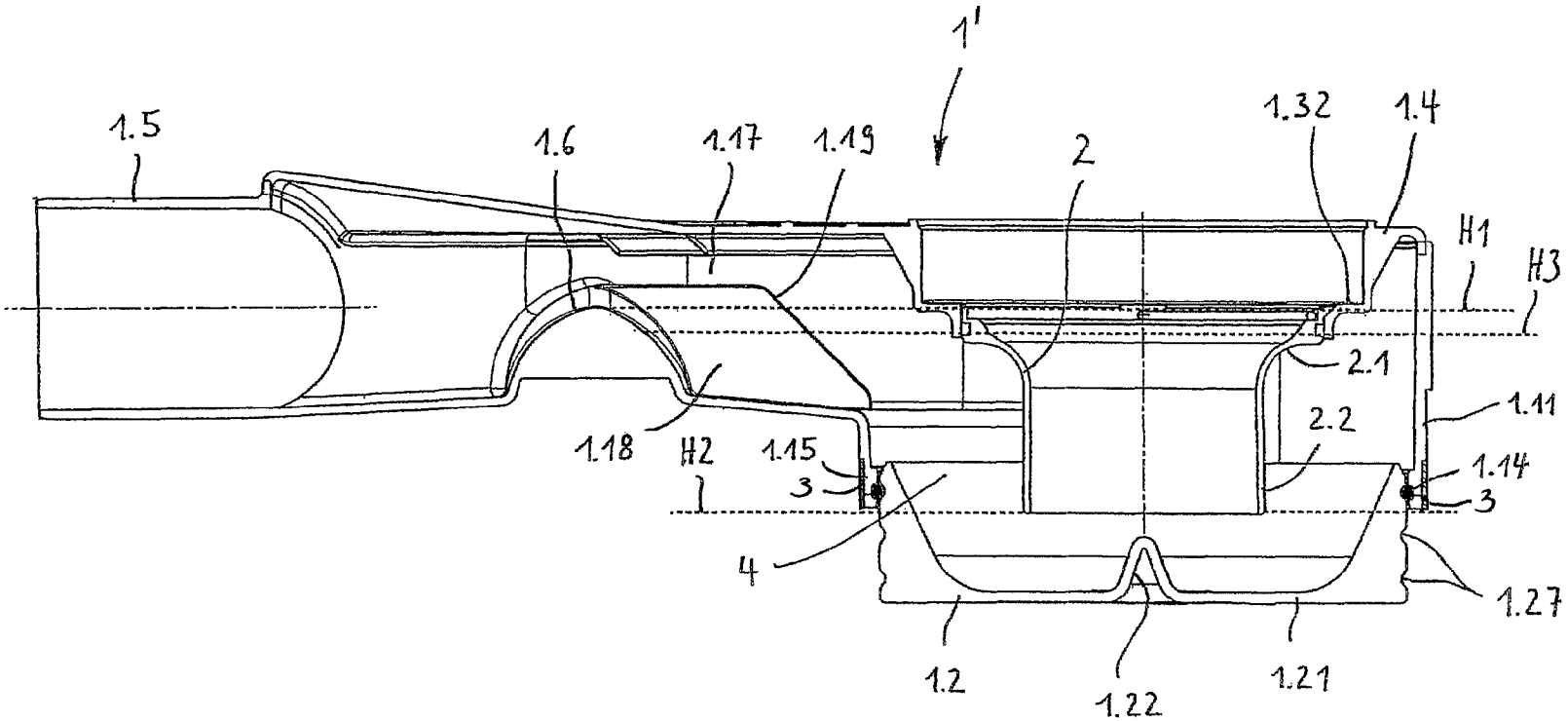
FIG. 4 illustrates another vertical sectional view of the drain of FIG. 3.

Another option for implementing a liquid tight connection which facilities an elevation adjustment of the base component relative to the drain housing is illustrated in FIGS. 3 and 4. The embodiment illustrated therein differs from the embodiment according to FIGS. 1 and 2 in that interlocking elements are configured at the base component 1.2 and at the drain housing 1.1, so that the base component 1.2 is elevation adjustable in increments relative to the drain housing 1.1.

The drain housing 1.1 includes a cylindrical, preferably circular cylindrical section 1.11 into which the shell shaped base component 1.2 is inserted. An annular groove 1.13 is configured at the inner circumference of the cylindrical housing section 1.11. A seal 1.14 configured as an 0-ring made from rubber or the like is inserted into the annular groove 1.13, wherein the seal 1.14 protrudes in radially inward direction relative to the annular groove 1.13. The shell shaped, also preferably circular cylindrical base component 1.2 includes several axially offset annular grooves 1.27 on its outer circumference, wherein the annular grooves are associated with the annular groove 1.13 of the drain housing 1.1. The annular grooves 1.27 of the base component 1.2 are offset from one another at even intervals. In the illustrated embodiment, the base component 1.2 includes three annular grooves 1.27. However, it shall be understood that the elevation adjustability according to the invention of the base component 1.2 is also implemented when the base component 1.2 only includes two annular groves 1.27. The base component 1.2 can also include more than three annular grooves 1.27. The annular groove 1.13 of the drain housing 1.1 with the annular seal 1.14 inserted therein and the grooves 1.27 of the base component 1.2 represent interlocking elements, wherein the seal 1.14 engages one of the grooves 1.27 of the base component 1.2 in a positive locking manner as a function of the adjusted position of the base component 1.2 relative to the drain housing 1.1. A tension band 3 is disposed at the cylindrical section 1.11 of the drain housing 1.1, wherein the base component 1.2 is clamped and fixated from the outside at the drain housing 1.1 through the tension band 3. The cylindrical section 1.11 of the drain housing 1.1 includes a circumferential, radially inward protruding shoulder 1.15, wherein the annular groove 1.13 retaining the seal ring 1.14 is configured at the inside of the inward protruding shoulder 1.15. The circumferential outer edge 1.16 of the shoulder 1.15 is used as an axial stop for the tension band 3.

The thickness of the side wall of the shell shaped base component 1.2 according to FIGS. 3 and 4 increases from the upper end to the base 1.21. Thus the base component 1.2 defines a cavity conically tapering towards the base 1.21.

The immersion pipe 2 is configured as one piece in the illustrated embodiments. In order to adapt the length of the immersion pipe 2 to the total height of the drain 1, 1' adjusted through the elevation adjustment of the base component 1.2, or in order to adjust the water lock height or the drain output as a function of the requirements for the drain, the immersion pipe 2 is shortened to the required length once. Shortening the immersion pipe 2 can be performed with a saw or with a knife.

In the embodiment illustrated in FIG. 1 the immersion pipe 2 includes several axially offset circumferential protrusions (annular protrusions) 2.5. The protrusions 2.5 are offset from one another at even distances and serve as guidance for a cutting tool when the immersion pipe 2 is shortened.

In order to adjust a maximum water lock height, the immersion pipe 2 is inserted into the drain housing 1.1 without being shortened. By adjusting the height of the base component 1.2 relative to the drain housing 1.1 and relative to the immersion pipe 2 inserted therein, the drain output of the drain can be varied. A reduction of the distance between the base edge of the immersion pipe 2 and the base 1.21 of the base component 1.2 leads to a reduction of the width of the annular cross section and thus to a reduction of the output of the drain. The parameters installation height and water lock height can be adjusted for the drain according to the invention separately from one another. The drain output is based on the selected setting (configuration).

The lower section 2.2 of the immersion pipe 2 is configured cylindrical, wherein the upper section 2.1 circumferentially expands in a conical manner or like a funnel towards the upper end of the section 2.1. The immersion pipe 2 defines with the base component 1.2 or the drain housing 1.1 an annular drain channel (annular cavity) 4, wherein the cross sectional width of the drain channel increases from the bottom to the top.

In the cover component 1.4 of the drain housing 1.1 a recess is formed which includes a shoulder 1.32. A grid (not shown) or a frame supporting the grid (not shown) can be inserted into the recess which is preferably configured circular cylindrical. The inner edge of the shoulder 1.32 is configured beveled at least over a partial circumference of the opening 1.3. The bevel 1.34 is used as a support for the immersion pipe 2, wherein the flange shaped end of the immersion pipe 2 includes a slant angle at its outer circumference, wherein the slant angle is configured complementary to the bevel.

The drain housing 1.1 illustrated in FIG. 1 includes an overflow edge (water lock barrier) 1.6 extending transversal to the longitudinal center axis of the pipe connection 1.5. A drain channel expansion 1.7 is configured in front of the overflow edge viewed in drain flow direction, wherein the drain channel expansion tapers towards the overflow edge 1.6 (cf. FIG. 1). Thus, the drain channel expansion 1.7 is at least partially formed through a bead formed on the inside of the drain housing 1.1.

The drain channel expansion 1.7 is part of a horizontal disc shaped drain channel section 1.8 which is limited by the immersion pipe 2 and the drain housing 1.1. The volume of this disc shaped drain channel cross section is greater/equal to the volume in the immersion pipe 2 which is limited by a top horizontal plane H1 extending tangential to the water lock barrier 1.6 and by a lower horizontal plane H2 extending tangential to the lower end of the immersion pipe 2.

Also the drain housing 1.1 illustrated in FIGS. 3 and 4 includes an overflow edge (water lock barrier) 1.6 extending transversal to the longitudinal axis of the pipe connection 1.5. Differently from the embodiment according to FIG. 1, the overflow edge 1.6 includes an elevation offset 1.61 transversal or orthogonal to the longitudinal center axis of the pipe connection 1.5 (cf. FIG. 3). In the embodiment according to FIGS. 3 and 4 the water lock barrier 1.6 with its center section 1.62 is configured lower than in its sections 1.63 which end at the side walls 1.17 of the drain housing 1.1 which define the drain channel leading to the pipe connection 1.5. The elevation offset 1.61 is at least 5%, preferably at least 8% of the inner diameter of the pipe connection 1.5.

Divider walls (bulkheads) 1.18 are integrally formed at the water lock barrier, wherein the divider walls extend in a direction towards the immersion pipe 2 and terminate at the cylindrical section 1.11 of the drain housing 1.1 which is configured for receiving the base component 1.2. The divider walls 1.18 are integrally configured with the overflow edge 1.6 and at the base of the drain housing 1.1 in the portion of the elevation offset 1.61 and extend essentially vertically and essentially parallel to one another. The height of the divider walls 1.18 corresponds essentially to the greatest height of the overflow edge 1.63. The faces 1.19 of the bulkheads 1.18 oriented towards the inlet opening 1.3 are configured with a bevel, wherein the faces 1.19 taper downward in a direction towards the base component 1.2.

The dashed line H2 designates the lower edge of the immersion pipe in FIG. 4. The lower edge of the immersion pipe defines the air pass through level of the drain for a water extraction through suction caused by vacuum of the sewer conduit. The upper dashed line H1 corresponds to the water level in the drain housing 1.1 before a malfunction caused by water extraction through suction, wherein the dashed line designated H3 represents the water level after a malfunction of this type. It is apparent that the drain according to the invention provides a high level of back suction safety with a rather flat configuration.

The implementation of the present invention is not limited to the embodiments described supra. Rather numerous variations are possible which make use of the invention defined by the appended patent claims also for configurations which differ from the embodiments.

The invention claimed is:

1. A drain for floor level showers, the drain comprising a drain housing including a section having a substantially cylindrical structure with vertical sidewalls and a cylindrical cavity, a base component without a pipe connection, an inlet opening at a top side of the drain housing, and an immersion pipe which is insertable into the drain housing through the inlet opening and defines a stench trap with the drain housing, wherein the drain housing comprises a laterally disposed pipe connection, wherein the base component comprises a base and sidewalls defining a cavity, wherein the base component is connected in an elevation-adjustable and liquid-tight manner with the drain housing, wherein the drain housing internally comprises a water lock barrier which extends transversal or orthogonal to the longitudinal center axis of the pipe connection and protrudes in a vertical direction, and wherein the water lock barrier comprises an elevation offset viewed in a direction transversal or orthogonal to the longitudinal center axis of the pipe connection.

2. The drain according to claim 1, wherein the immersion pipe is configured so that it has to be shortened by cutting off an immersion pipe section for reducing the axial length of the immersion pipe.

3. The drain according to claim 1, wherein the base component and the drain housing are respectively provided with a thread which can be threaded into one another.

4. The drain according to claim 1, wherein interlocking elements are formed at the base component and the drain housing, so that the base component is elevation-adjustable in increments relative to the drain housing.

5. The drain according to claim 1, wherein an annular seal is disposed between the base component and the drain housing.

6. The drain according to claim 5, wherein the seal is inserted into an annular groove configured at the drain housing.

7. The drain according to claim 1, further including a tension band through which the base component can be clamped and fixated at the drain housing.

8. The drain according to claim 1, wherein the immersion pipe comprises several axially offset annular grooves and/or annular protrusions.

9. The drain according to claim 1, wherein the immersion pipe protrudes freely with a radial distance into the base component of the drain, so that the immersion pipe and the base component of the drain define an annular cavity in combination.

10. The drain according to claim 1, wherein the immersion pipe, the base component, and the drain housing define an annular drain channel whose cross sectional width increases from bottom to top.

11. The drain according to claim 1, wherein at least one divider wall is integrally formed at the water lock barrier, said divider wall extending in a direction towards the immersion pipe.

12. The drain according to claim 11, wherein the divider wall is integrally molded at the water lock barrier in a portion of the elevation offset and extends substantially in a vertical direction.

13. The drain according to claim 1, wherein the elevation offset of the water lock barrier is at least 5% of the inner diameter of the pipe connection.

14. The drain according to claim 1, wherein a drain channel expansion is configured viewed in drain direction in front of the water lock barrier, wherein the drain channel expansion tapers towards the water lock barrier.

15. The drain according to claim 1, wherein the base component comprises a cone shaped base section which protrudes in a direction towards the immersion pipe and is enveloped by the immersion pipe.

16. The drain according to claim 1, wherein the base component has a shell shaped structure in which the sidewalls taper toward the base.

* * * * *